US007665629B2

(12) United States Patent
Julius et al.

(10) Patent No.: US 7,665,629 B2
(45) Date of Patent: Feb. 23, 2010

(54) RESEALABLE PERFORATED LABEL FOR CONSUMER PRODUCTS

(75) Inventors: Robert P. Julius, Greenwich, CT (US); Gary Vance, East Windsor, NJ (US)

(73) Assignee: Nice-Pak Products, Inc., Orangeburg, NY (US)

( * ) Notice: Subject to any disclaimer, the term of this patent is extended or adjusted under 35 U.S.C. 154(b) by 550 days.

(21) Appl. No.: 10/755,690

(22) Filed: Jan. 12, 2004

(65) Prior Publication Data

US 2005/0150785 A1 Jul. 14, 2005

(51) Int. Cl.
*B65H 1/00* (2006.01)
*A47F 1/04* (2006.01)

(52) U.S. Cl. ..... 221/63; 221/302

(58) Field of Classification Search ..... 221/63, 221/302

See application file for complete search history.

(56) References Cited

U.S. PATENT DOCUMENTS 2,619,009 A * 11/1952 Begle ..... 409/137
2,619,226 A * 11/1952 Adams ..... 221/63
3,910,410 A 10/1975 Shaw
3,938,659 A 2/1976 Wardwell
3,986,479 A * 10/1976 Bonk ..... 118/506
4,181,225 A 1/1980 Spiegelberg
4,185,754 A * 1/1980 Julius ..... 221/63
4,192,420 A 3/1980 Worrell, Sr. et al.
4,420,080 A 12/1983 Nakamura
4,458,810 A * 7/1984 Mahoney ..... 206/210
4,610,357 A 9/1986 Nakamura
4,651,874 A 3/1987 Nakamura
4,735,317 A * 4/1988 Sussman et al. ..... 206/449
4,762,124 A 8/1988 Kerch et al.
4,790,436 A 12/1988 Nakamura
4,840,270 A 6/1989 Caputo et al.
4,848,575 A * 7/1989 Nakamura et al. ..... 206/449
5,145,091 A * 9/1992 Meyers ..... 221/45
5,160,767 A 11/1992 Genske et al.
5,242,057 A * 9/1993 Cook et al. ..... 206/581
5,344,007 A 9/1994 Nakamura et al.
5,379,897 A * 1/1995 Muckenfuhs et al. ..... 206/494
5,524,759 A 6/1996 Herzberg et al.
5,531,325 A * 7/1996 Deflander et al. ..... 206/494
5,595,786 A 1/1997 McBride, Jr. et al.
5,613,608 A 3/1997 Tronchetti et al.
5,664,677 A * 9/1997 O'Connor ..... 206/494
5,672,224 A 9/1997 Kaufmann
5,683,029 A 11/1997 Lyons
5,725,311 A 3/1998 Ponsi et al.
D394,605 S 5/1998 Skiba et al.
5,791,465 A 8/1998 Niki et al.
5,855,434 A 1/1999 Hagen (Continued)

*Primary Examiner*—Patrick Mackey
*Assistant Examiner*—Michael E. Butler
(74) *Attorney, Agent, or Firm*—Lerner, David, Littenberg, Krumholz & Mentlik, LLP

(57) ABSTRACT

A dispenser for consumer product packaging is disclosed, the dispenser including a removable region of the packaging creating a product opening upon removal, a reinforcement surface overlaying the removable region, a disposable adhesive label for initially opening the package by removal of the removable region of the packaging and reinforcement surface, and a durable enclosure, the durable enclosure bonded to the product packaging and resealable to allow access and preservation of a consumer product such as interleaved tissues in the packaging after initial opening.

30 Claims, 3 Drawing Sheets

U.S. PATENT DOCUMENTS 5,996,797 A * 12/1999 Flaig ..... 206/494
6,026,953 A * 2/2000 Nakamura et al. ..... 206/233
6,056,141 A 5/2000 Navarini et al.
6,113,271 A * 9/2000 Scott et al. ..... 383/211
6,126,009 A 10/2000 Shiffler et al.
6,126,317 A 10/2000 Anderson et al.
6,413,599 B1 7/2002 Petricca et al.
6,431,360 B1 * 8/2002 Julius ..... 206/494
7,228,968 B1 * 6/2007 Burgess ..... 206/494

* cited by examiner

RESEALABLE PERFORATED LABEL FOR CONSUMER PRODUCTS

FIELD OF THE INVENTION

The present invention relates in general to packages for consumer products, and more particularly relates to resealable dispensers for repeated use in dispensing consumer products there from.

BACKGROUND OF THE INVENTION

Certain consumer products, such as baby wipes and premoistened cleaning cloths, lose moisture and effectiveness if exposed to the air. A number of resealable, disposable product packages have been developed to hold such products. These packages include dispensers that attempt to provide access to the product when opened while sealing the package from the outside environment when closed. Such dispensers include resealable features, which may take the form of, for example, an adhesive label, a bag lip, or a door-and-hinge arrangement.

Some of such dispensers employ a resealable adhesive label. The resealable adhesive label seals the consumer product packaging access point to the consumer product when closed. Upon opening the adhesive label, access to the product is enabled through the consumer product access point. After product use, the adhesive label is resealed, resealing the consumer packaging, until the product needed again.

Although such resealable adhesive labels are simple to produce and are easily used by consumers, these adhesive labels suffer some substantial drawbacks. First, most resealable labels employ resealable adhesives that are by nature weak: after repeated uses of the adhesive label, the resealable adhesive loses bonding power and no longer effectively seals the consumer package. Second, the resealable adhesive can prematurely lose bonding power if the adhesive becomes dirty, or if the adhesive comes in contact with moisture. Frequent resealing, dirt, and moisture are each common in a consumer environment, and as such, early failure of a resealable adhesive label can result in spoilage of a product long before either the product is used or the expected product lifetime has expired.

A second type of dispenser employs a product packaging (typically in the form of a bag) with a locking seam flange along the opening in the packaging, in a manner similar to those found in Ziploc® bags and similar consumer storage bags. Namely, to access product, the locking seam flange is pulled apart, and the locking seam flange is resealed after product use. However, a locking seam flange has its own drawbacks. First, it is sometimes difficult to tell whether the locking seam flange has been sealed along the entirety of the opening in the product packaging—and if the seal is not complete, the product may expire, dry out, or lose its effectiveness before the product is used or before the expected product lifetime has expired. Furthermore, the opening and closing of a locking seam flange along the entire open side of a consumer packaging requires the use of both hands and careful finger and pressure placement. Such dexterity may be inconvenient in some consumer applications, and use of a locking seam flange may be difficult or impossible for small children, those with disabilities, or those with arthritic conditions.

A third type of dispenser employs a hard plastic product packaging with a hard plastic flip-top lid. In such packaging, a hard plastic cover is simply coupled to the packaging via a hinge and locking mechanism or locking tab. Unlocking and opening the cover provides access to the product, and closing and relocking the cover protects the product from the outside environment. However, hard plastic product packaging is typically more expensive to produce and may have certain environmental disposal concerns. Furthermore, hard plastic packaging may not be spatially efficient, requiring a large volume to hold a relatively small amount of consumer product. Finally, protection of the consumer product is solely reliant on the effectiveness of the seal of the hard top cover and the hard packaging. Prior to consumer use, such hard plastic packaging is typically shrink-wrapped to ensure that the product does not expire, dry out, or lose its effectiveness before the product is used or before the expected product lifetime has run its course. Such a shrink-wrap effectively requires two layers of product packaging and further adds to the costs of such hard plastic product packaging.

SUMMARY OF THE INVENTION

The present invention overcomes various drawbacks of the known resealable packages by providing an effective resealable dispenser for a consumer product.

In one aspect of the invention, a product packaging including a resealable dispenser is provided that allows repeated resealing of the dispenser without loss of an effective seal over time.

In another aspect of the invention, a dispenser for product packaging employing a plurality of material that ensures the dispenser is durable enough to withstand repeated consumer use and long term storage.

In another aspect of the invention, a dispenser for product packaging is provided that can easily be opened and closed, typically with one hand, without loss of effective seal.

In another aspect of the invention, a dispenser for product packaging is provided that does not require the product packaging to be made entirely of more expensive hard plastic materials. In one aspect of the invention, a package for a product is provided, including a first material defining a package with an interior and an exterior, the first material including a removable region; a second material, the second material adhered to the first material at least around the removable region of the first material; a third material, the third material adhered to at least one of the first material and the second material, the third material covering the removable region of the first material, whereby removal of the third material causes removal of the removable region of the first material creating an opening in the packaging therein; and, an enclosure including a cover resealably coupled to resealingly cover the opening formed by removal of the removable region on the first material, the enclosure adhered to at least one of the first material and the second material and disposed surrounding the opening formed by removal of the removable region for access thereto upon displacement of the cover.

In another aspect of the invention, a method for opening a package containing a product therein is disclosed, the package including a first material including a removable region therein, a second material adhesively bonded to the first material in a region at least surrounding the removable region in the first material, a third material releasably adhered to at least one of the first material and the second material, the third material completely covering the removable region, and a fourth material including an enclosure, the fourth material adhesively bonded to at least one of the first material and the second material, the enclosure completely covering the removable region in the first material, the method including: opening the enclosure of the fourth material, simultaneously removing the third material from the package and the removable region of the first material; and, accessing a product stored within the package through an opening formed upon removal of the removable region. The method may further include the step of releasably opening and resealing the package through releasably opening the enclosure of the fourth material to obtain access to a product therein, and resealably closing the enclosure of the fourth material after product access.

DETAILED DESCRIPTION

Figure 1:
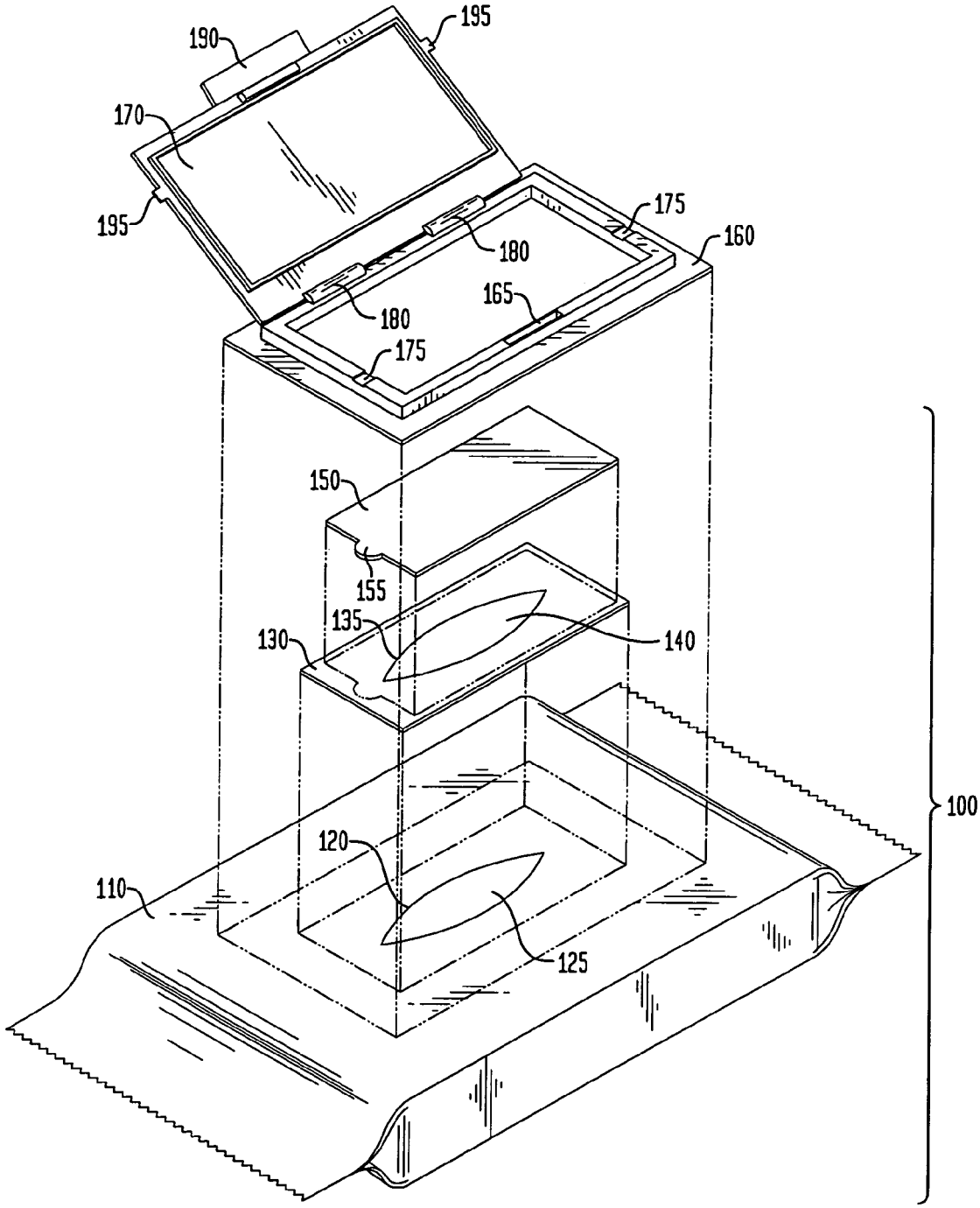
FIG. 1 is an exploded unassembled perspective view of one embodiment of the present invention.

FIG. 1 shows an exploded view a consumer package in accordance with one embodiment, which includes a first packaging material 110. The first packaging material 110 which forms the package for the product to be dispensed is preferably a flexible plastic-based packaging material such as, for example, polybags. However, it is to be understood that the package 100 may be formed of any material sufficiently durable to store product before and during consumer use, including flexible and rigid material, and combinations thereof. The packaging material 110 forms a complete package for a product (not shown) residing inside the package. On at least one surface of the packaging material 110, a die-cut 120 is made into the packaging material. Preferably, the removable region 125 inside of the die-cut 120 is not removed upon creation of the die-cut 120 and remains intact until consumer use of the package 100. The removable region 125 is preferably cut in a "modified football" shape with sharp edges, as further described below.

Although in this embodiment the removable region 125 is created via a die-cut 120, the removable region can be created by other means such as, for example, perforation, heat, compression, laser, or other similar cutting or perforation methods. The shape of the die-cut may be oval, round, rectangular or any shape desired which enables dispensing of product there through. The removable region 125 defined by the die cut 120 may be removed at any point during manufacture of the package 100, but preferably is left in place until first consumer use, as described below, in order to further seal the consumer product stored therein before consumer use.

A second, reinforcement material 130 serving, in one embodiment, as a reinforcement label is adhered to the first packaging material 110 such that the second material adheres to or is otherwise attached to the region immediately surrounding the die-cut 120 in the first material 110. The reinforcement material 130 is preferably also a plastic product, and even more preferably it is the same plastic or a compatible plastic with the packaging material 110. The reinforcement material 130 is preferably bonded to the packaging material 110 via, for example, an adhesive, thermal bonding, or other bonding mechanism, and more preferably a permanent adhesive such that the first packaging and second reinforcement materials are sufficiently bonded as to not come apart upon application of force by an end-user sufficient to open the typical consumer packaging 100 (that is, for example, preferably the bond will not come apart on application of a force of 75 Newtons or less, and more preferably the bond will not come apart on application of a force of 150 Newtons or less, and most preferably will withstand application of a force of 200 Newtons or less.)

Advantageously, the reinforcement material 130 also has a die-cut 135 providing a reinforcement material removable region 140, such that when the packaging material and reinforcement material are bonded the reinforcement material removable region 140 substantially overlays, overlaps and/or covers the packaging material removable region 125 and thereby reinforces the first material in the area immediately surrounding the removable region 125. The removable region 140 defined by the die cut 135 may be removed at any point during manufacture of the package 100, but preferably is left in place until first consumer use, as described below, in order to further seal the consumer product stored therein and strengthen the integrity of the product package before consumer use. Pre-consumer use removal of the die cut 135 does not necessarily require removal of the package die cut 120, and vice-versa.

A third material 150, serving in one embodiment as a removable label, is bonded to the reinforcement material 130 such that the removable material preferably covers at least all of the die cut 135 in the reinforcement material (whether the removable region 140 has been preliminary removed or remains present) and/or the removable region 140 of the reinforcement material and the region of the reinforcement material immediately surrounding that removable region 140. The removable material 150 is bonded to the reinforcement material 130 via a removable adhesive, such that upon application of force by an end-user consumer, the removable material 150 is readily removable from at least most of the reinforcement material 130. Preferably, upon removal of the removable material 150 by an end-user, the removable region 140 of the reinforcement material 130, as well as the removable region 125 of the packaging material 125 (which is, in this embodiment, permanently bonded to the removable region 140 of the reinforcement material) are also both removed with the removable material 150.

In this manner, the first, package material 110, second, reinforcement material 130 and third, removable label material 150 form a seal to protect the product inside the packaging until the end-user removes the third material 150. Upon removal of the third material 150 (and accompanying second material removable region 140 and first material removable region 125) the end-user now has access to the product inside the packaging.

An enclosure, in one embodiment including a cover 170 and framed base 160 are employed to permit an end-user to resealably have access to the product within the product packaging. The cover 170 and base 160 are preferably made of a material more durable than the product packaging, and more preferably are a hard plastic suitable for repeated use in consumer product packaging.

The base 160, in one embodiment in the nature of a closed frame is bonded to the product packaging itself via an adhesive, preferably a permanent adhesive, such that the base surrounds the removable region 140 of the reinforcement material and the removable region 125 of the packaging material. Alternatively, the base 160 may be similarly bonded to the reinforcement material 130. Preferably, base forms a seal along its perimeter with the first, packaging material and/or second, reinforcement material in order to prevent spoilage of the product held inside the product packaging.

The cover 170 is coupled to the base 160 via at least one hinge 180 such as a living hinge, and is locked to the base upon closure via a locking tab 190 that interfaces with a corresponding locking flange 165 of the base 160. Secondary locking surfaces 195 on the cover 170 similarly interface with secondary locking surfaces 175 of the base. In this way, the cover 170 and base 160 form a substantially airtight seal when closed to preserve the product in the product package, but the cover 170 can be easily opened from the base 160 via the locking tab in order to obtain access to the product in the consumer packaging 100. The substantially airtight seal is not necessarily entirely airtight, but is sufficiently sealed to prevent spoilage of the consumer product kept within the housing. Other enclosures are readily used as well, such as the use of snapping locks or other resealable couplings between the enclosure and the package.

Figure 2A:
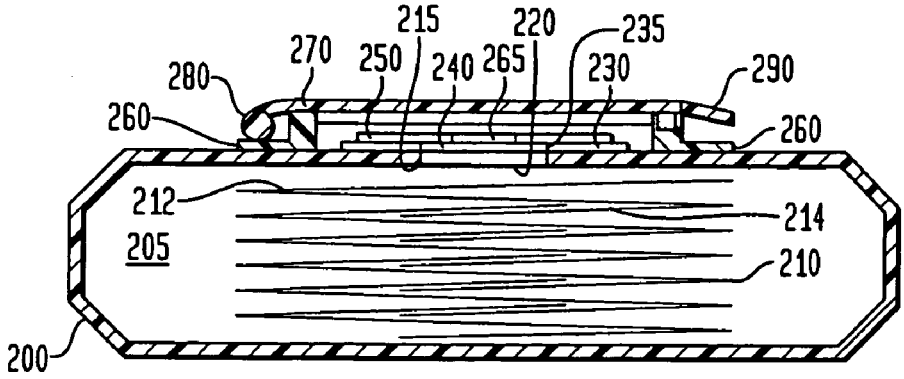
FIG. 2*a* is a cross-sectional view of one embodiment of the present invention prior to consumer use.

FIG. 2*a* shows a cross-sectional view of one embodiment of the present invention prior to consumer use. A consumer product 210, such as, for example, baby wipes, tissues, or other dispensable consumer products, are stored within the space 205 of a product packaging 200 constituted of a material suitable for long term storage and consumer use of the product, such as, for example, plastics, coated papers, or light metals such as aluminum alloys, and the like. The product packaging 200 includes a removable region 220, the removable region 220 bounded by a die cut 215 or other perforation of the product packaging surface. Directly above the removable region 220, a reinforcement material 230 is permanently adhered to the product packaging 200. The reinforcement material 230 also includes a reinforcement removable region 240 directly above the packaging removable region 220, defined by a reinforcement region die cut 235.

The consumer product 210 is typically a dry or moist tissue, and the dispenser is typically of the "pop-up" dispensing variety in particular. Generally, each tissue has a leading portion 212 that is first to pass through the opening, and a trailing portion 214 that later passes through the opening. In an "interleaved" arrangement, as is preferably used herein, the trailing portion 214 of a first tissue to be dispensed overlaps the leading portion 212 of the next tissue to be dispensed. As the first tissue is withdrawn by the user, the leading portion of the next tissue is pulled through the opening, for later dispensing. The tissues are folded against one another in a variety of configurations so that the friction of the trailing portion of the withdrawn sheet against the succeeding sheet pulls the leading portion of the succeeding sheet through the opening. Such an interleaved arrangement is preferred for tissue-type consumer products dispensed through the present dispensing system through the removable region and reinforcement removable region as described herein. However, other arrangements for individual removal of these tissue-type consumer products are possible, such as a continuous product separated into individual towels by rows of perforations or the like. In that case, the removal of the leading edge of the initial towel is carried out so as to break or tear the next adjacent row of perforation, so as to then present the next towel for removal therefrom.

In particular, the friction arrangement of interleaved or perforated tissues coupled with the reinforced aperture (preferably of a modified football shape as described below) presents a combination of easy promotion of the next tissue from either an interleaved or perforated set of tissues and sufficient rigidity at the product opening to allow the current tissue being removed to be so removed while promoting the next tissue, but advantageously not carrying the next tissue out of the product opening at the same time. This combination of friction from interleaved tissues coupled with the rigidity and shape of the product opening is preferred given its ease of use, promotion of a single tissue at a time, and sufficient rigidity to prevent ripping or promotion of multiple tissues simultaneously. Without the necessary rigidity of the reinforcement material the possibility that the next adjacent tissue will not properly separate, but instead will be removed along with the initial tissue or towel, exists. This is sometimes referred to as "roping." Again, the rigidity of the reinforcement material, as well as the shape and nature of the die cut formed therein, as discussed below, act to provide for proper tissue separation during use.

The reinforcement material 230 and the reinforcement removable region 240 are, alternatively, permanently adhered directly to the inner surface of the packaging material 200. Also, alternatively the reinforcement material 230 is bonded to the packaging material 200 via, for example, an adhesive, a heat seal, pressure or a seam.

A removable label 250 is placed on top of the reinforcement material 230 and removably adhered to the reinforcement material, such that the removable label 250 covers the removable region 240 of the reinforcement material. In the exemplary alternative embodiment mentioned above, the removable label 250 is placed on the top surface of the packaging material 200 and removably adhered to the packaging material 200 such that the removable label 250 covers the removable region 220 of the packaging material 200.

Surrounding the removable label 250 and reinforcement material 230 is a base 260 and cover 270 made of a material sufficiently strong as to allow repeated consumer opening and closing of the base 260 and cover 270 without breakage. The base 260 and cover 270 are preferably coupled via a hinge that permits opening, and in the closed position is locked via a locking tab 290 on the cover that locks with a locking flange of the base (not shown), as previously described.

A portion of the removable label 250 may advantageously include a tab 265. The consumer opens the package by opening the cover 290 and base 260 via operation of the locking tab 290 and opening the cover 290 along the hinge 280. Thereupon, the consumer has access to the removable label 250. Upon pulling on the tab 265 of the removable label 250, the removable label 250, the removable region 240 of the reinforcement material 230, and the removable region 220 of the packaging material 200 are all removed from the consumer packaging. After initial opening, the removable label 250, removable region 240 of the reinforcement material 230 and removable region 220 of the product packaging 200 are preferably disposed of.

Figure 2B:
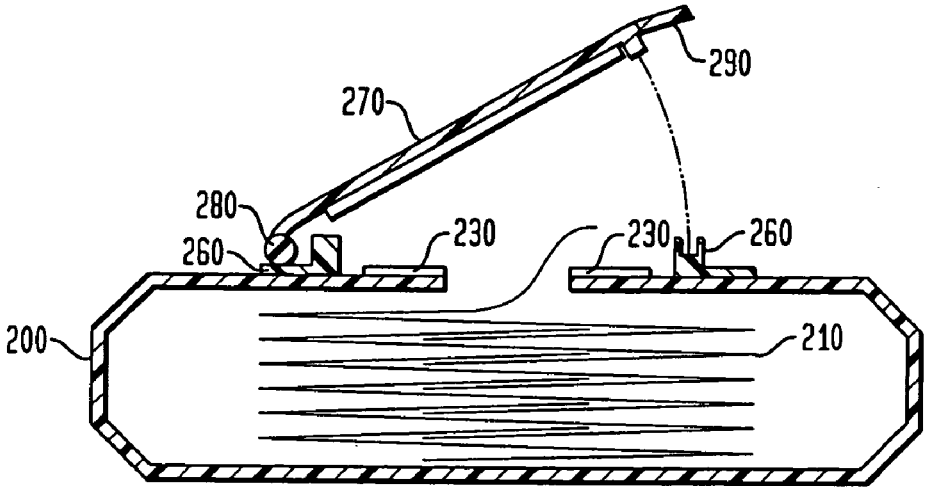
FIG. 2*b* is a cross-sectional view of one embodiment of the present invention during consumer use.

FIG. 2*b* shows a cross-sectional view of one embodiment of the present invention when open during consumer use. Once the product packaging is initially opened and the removable label 250 (see FIG. 2*a*) is removed, then consumer access to a consumer product 210, preferably interleaved tissues, is affected by opening the cover 270 via operation of the locking tab 290 and the hinge 280. Whereupon, the product 210 can be removed (either as individual sheets or in another appropriate fashion) through the opening (preferably a modified football shape as described below) formed via the die cut 215 in the product packaging 200 and the reinforcement material 235.

Figure 3:
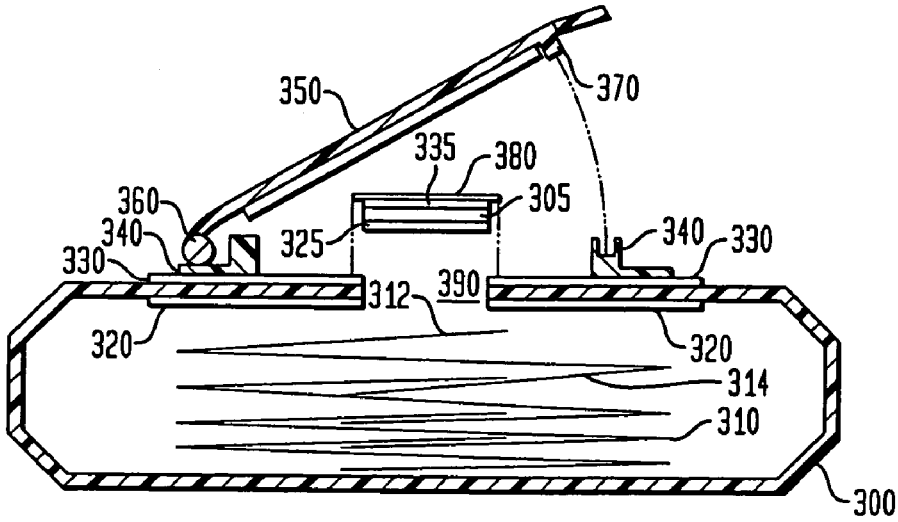
FIG. 3 is a cross-sectional view of a partially assembled embodiment of the present invention.

FIG. 3 shows an exploded view of one embodiment of the present invention. In this embodiment, as before, a consumer package including consumer packaging material 300 contains a consumer product 310 such as, for example, interleaved pre-moistened tissues. In this embodiment, the interleaved pre-moistened tissues 310 each include a leading portion 312 and a trailing portion 314 for promoting the next tissue to the product opening on use, as previously described. On one side of the packaging material 300 is a removable region 305, preferably of a modified football shape as described below, defined by a pre-determined die-cut shape (not shown in cross section). Below the removable region 305 of the packaging material 300, a subjacent reinforcement material 320 is bonded to the packaging material 300 via, for example, adhesive, such that the removable region 305 is reinforced by the subjacent reinforcement material 320. The subjacent reinforcement material includes its own removable region 325 directly below the removable region 305 of the packaging material 300. Similarly, a superjacent reinforcement material 330 is bonded to the packaging material above the product packaging via, for example, an adhesive, with a similar superjacent removable region 335 directly above the removable region 305 of the packaging 300. In this embodiment, the base 340 is bonded directly to the superjacent reinforcement material 330, and the base 340 is coupled to a cover 350 via a hinge 360. The base 340 and cover are resealably openable via operation of the hinge and via a locking tab 370 which interacts with a locking flange as previously described.

A removable label 380 is bonded to the superjacent reinforcement material 330. The removable label 380 advantageously may include a tab (not shown), and upon operation of the tab, the removable label 380 is removed, and with the removal of the removable label 380 the removable regions 325, 305 and 335 of the subjacent reinforcement material 320, packaging material 300, and superjacent reinforcement material 330 respectively are removed as well. In order to ensure clean removal of all layers between the removable label 380 and the removable layers beneath it, additional bonding methods can be employed such as, for example, additional or more permanent adhesives, heating, pressure or seams. Upon removal of the removable label 380 and related removable layers 325, 305 and 335, the reinforced opening 390 permits consumer access to the product 310 therein.

The shape of the opening formed by the die cuts is advantageously created in such a way to permit individual sheets of consumer product to be removed while bringing up the next individual sheet to the opening. The "modified football" shaped opening includes at least a top and bottom curved edge, where the top and bottom curved edges meet at a first and second meeting point at an acute angle.

Figure 4:
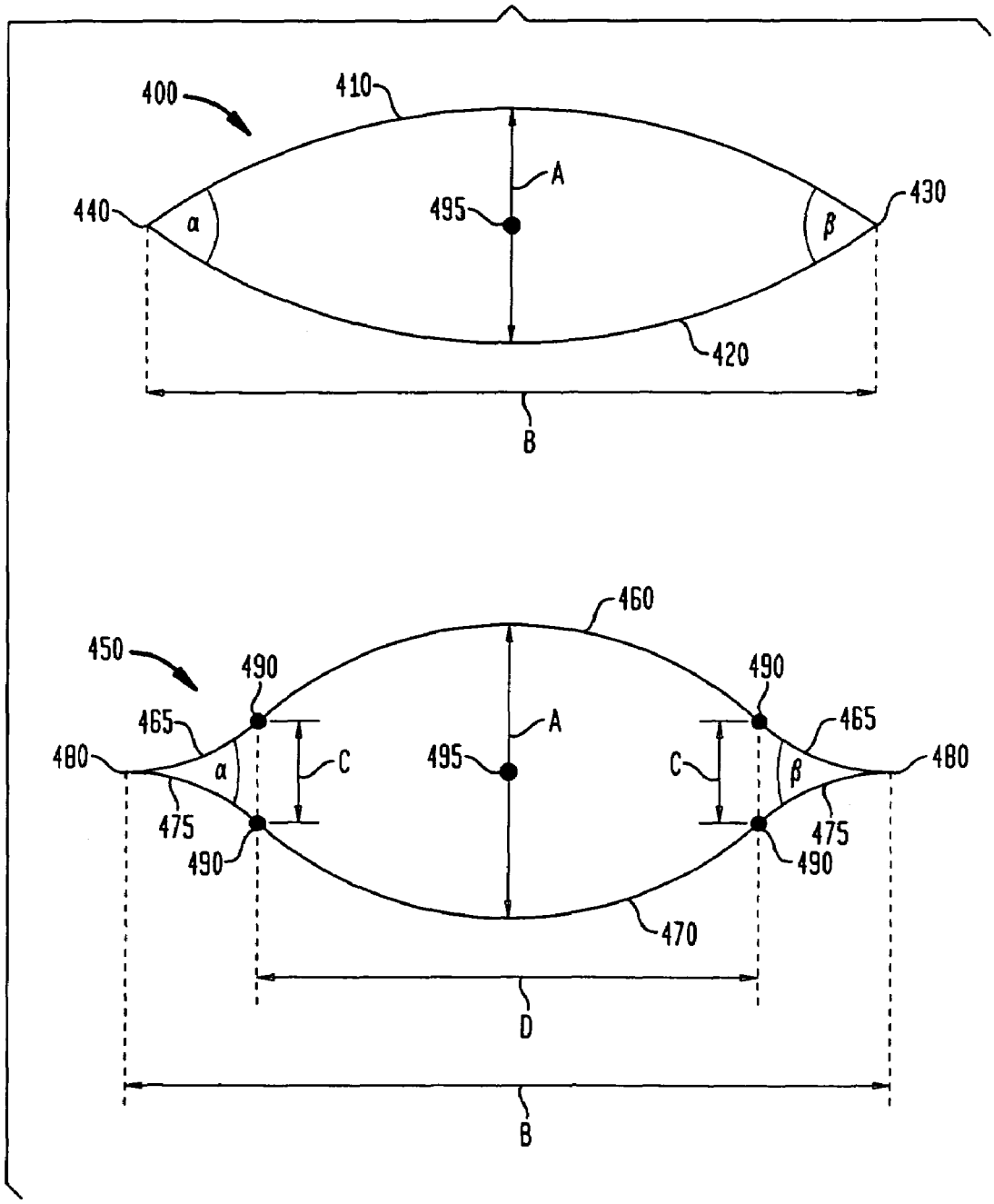
FIG. 4 shows a top-down view of two embodiments of packaging openings of the present invention.

FIG. 4 shows a top-down view of two embodiments of "modified football shape" openings of the present invention. A first aperture 400 includes an upper concave surface 410 and a lower concave surface 420. The distance between the apex of the upper concave surface 410 and lower concave surface is defined as A. The upper concave surface 410 and lower concave surface meet at a first meeting point 440 and a second meeting point 430. The first meeting point 440 forms an angle alpha ($\alpha$) of preferably less than 90 degrees, resulting in a relatively "sharp" meeting point that aids in the removal of consumer products, namely tissues, such that when the tissues are in the packaging in an interleaved format they are easily removed and the next interleaved tissue to be dispensed is easily pre-gathered through the aperture for the next use. Similarly, at the second meeting point 430, a sharp meeting point of angle beta ($\beta$) of preferably less than 90 degrees is created.

In another embodiment, a second aperture 450 also includes an upper surface 460 and a lower surface 470. However, each of the upper surface 460 and the lower surface 470 preferably has at least two symmetric inflection points 490, such that the central region of the upper surface 460 and the central region of the lower surface 470 is concave, while the outer regions of the upper surface 465 and the outer regions of the lower surface 475 are convex. The outer surfaces 465, 475 lead to meeting points 480 and 490, in this case forming angles alpha ($\alpha$) and beta ($\beta$) of preferably less than 45 degrees. Alternatively, for example, the outer surfaces 465 and 475 can be straight rather than convex, leading to meeting points 480 and 490 at angles alpha ($\alpha$) and beta ($\beta$). In either case, the relatively sharp meeting points 480 and 490, coupled with larger central region for tissue pull through, provides for even removal of single tissues and promotion of the next tissue in an interleaved package of tissues. As before, the distance between the apex of the upper surface 460 and the lower surface 470 is defined as A. The distance between the meeting points 480 and 490 is defined as B. Preferably, the width B is at least twice the height A, in order to provide easy removal of tissues and easy promotion of the next tissue to the aperture for removal. The inflection points 490 are vertically separated by a distance C, where C is typically about half of A or smaller. The distance horizontally between the inflection points is D, where typically D is smaller than B. Generally, the aperture exhibits horizontal and vertical symmetry around its center point 495, but such symmetries are not typically mandatory.

In this manner, the sharp ends of the meeting points of the modified football shape product opening provide sufficient rigidity and sharpness to permit easy removal of a tissue, easy promotion of the next tissue in an interleaved set of tissues in the packaging, prevention of ripping (due to, in part, the reinforcement) and prevention of promotion of multiple tissues at the same time.

Other apertures that can be used as alternatives are discussed, for example, in U.S. Pat. No. 6,499,626, entitled DISPENSER FOR ARTICLES, issued Dec. 31, 2002 and assigned to the assignee of the present application, which is hereby incorporated by reference in its entirety. Similarly, the product and apertures described in U.S. Pat. Nos. 5,542,568 and 5,542,567, both entitled MOIST TISSUE PACKAGE CONSTRUCTION AND TISSUE, both issued Aug. 6, 1996 and assigned to the assignee of the present application, which are both hereby incorporated by reference in their entirety.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A package for dispensing a consumer product, comprising:

a first material defining a package with an interior and an exterior, said first material including a removable region;

a second material, said second material permanently adhered to said first material at least around said removable region of said first material;

a third material, said third material adhered to at least one of said first material and said second material, said third material covering said removable region of said first material, whereby removal of said third material causes removal of said removable region of said first material creating an opening in the packaging therein; and, an enclosure including a cover resealably coupled to resealingly cover the opening formed by removal of said removable region on said first material, said enclosure adhered to at least one of said first material and said second material and disposed surrounding said opening formed by removal of said removable region for access thereto upon displacement of said cover, and said first and second materials remaining adhered to each other whereby said second material reinforces said first material at least around said opening during subsequent use of said package.

2. The package of claim 1, wherein said enclosure further comprises a base, said cover coupled to said base by means of a hinge, said base adhered to at least one of said first material and said second material.

3. The package of claim 1, wherein said second material is more rigid than said first material.

4. The package of claim 1, wherein said cover and said base are more rigid than said first material.

5. The package of claim 1, wherein said removable region is a die-cut section of said package material.

6. The package of claim 1, wherein said removable region is a perforated region in said package material.

7. The package of claim 1, wherein a removable portion of said second material is adhered to said removable region of said first material and is removable therewith.

8. The package of claim 1, wherein said second material does not extend to the removable region of said first material.

9. The package of claim 1, wherein said second material extends to the removable region of said first material, said second material including a second material removable region at least partially overlapping said first material removable region.

10. The package of claim 9, wherein said third material is adhered to at least a portion of at least one of said first material and said second material by a non-permanent adhesive.

11. The package of claim 10, wherein said third material is adhered to said removable region of at least one of said first material and said second material by a permanent adhesive.

12. The package of claim 1, wherein said third material is adhered to at least one of said first material and said second material by a non-permanent adhesive.

13. The package of claim 1, wherein said third material further comprises a tab thereon, said tab comprising a region of said third material at least partially not adhered to any material.

14. The package of claim 1, wherein said third material further comprises a tab thereon, said tab comprising a region of said third material adhered to any material by a weak adhesive sufficient for a single use.

15. The package of claim 1, wherein said third material includes printing thereon.

16. The package of claim 1, wherein said second material comprises a superjacent material, the superjacent material bonded to the exterior of the first material around the removable region.

17. The package of claim 1, wherein said second material comprises a subjacent material, the subjacent material bonded to the interior of the first material around the removable region.

18. The package of claim 1, wherein said second material comprises a superjacent material and a subjacent material, the superjacent material bonded to the exterior of the first material around the removable region, and the subjacent material bonded to the interior to the first material around the removable region.

19. The package of claim 2, wherein said cover and said base are sealably coupled by a releasably locking flange.

20. The package of claim 19, wherein said cover and said base, when closed, are substantially airtight.

21. The package of claim 1, wherein said removable region of said first material is generally in the shape of a football.

22. A method for opening a package containing a consumer product therein, the package comprising a first material including a removable region therein, a second material adhesively bonded to said first material in a region at least surrounding said removable region in said first material, a third material releasably adhered to at least one of said first material and said second material, said third material completely covering the removable region, and a fourth material including an enclosure, said fourth material adhesively bonded to at least one of said first material and said second material, said enclosure completely covering said removable region in said first material, the method comprising:

opening said enclosure of said fourth material, simultaneously removing said third material from said package and said removable region of said first material while leaving said second material adhesively bonded to said first material in a region at least surrounding said removable region in said first material; and, accessing a product stored within said package through an opening formed upon removal of said removable region.

23. The method of claim 22, further comprising the step of releasably opening and resealing said package through releasably opening said enclosure of said fourth material to obtain access to a product therein, and resealably closing said enclosure of said fourth material after product access.

24. A resealable package, comprising:

packaging material forming a package having a removable region therein, reinforcement means permanently coupled to said packaging material at least surrounding said removable region of said packaging material, sealing means adhered to at least one of said packaging material and said reinforcement means, said sealing means initially sealing said removable region in said packaging material, whereby removal of said sealing means causes removal of said removable region in said packaging material to form an opening therein while leaving said reinforcement means permanently coupled to said packaging material at least surrounding said removable region of said packaging material, and, means permanently coupled to at least one of said packaging material and said reinforcement means for resealably openable access to said opening formed by removal of said removable region in said packaging material.

25. The resealable package of claim 24, wherein said removable region is generally in the shape of a football.

26. A storage device for a product, comprising:

a package formed from a container material having a container surface;

a first removable region cut into said container surface, a lower label at least partially disposed over said first removable region, said lower label having a second removable region disposed in alignment with said first removable region of said container surface, said lower label including a portion permanently adhered to said container surface at least around said second removable region, an upper label adhered to at least one of said removable region of said container surface and said lower label;

said upper label including at least one tab, said tab unadhered to said container surface, said tab facilitating engagement of said upper label for disadhereing at least said upper label from said package and for detaching said first removable region of said container surface and said second removable region of said lower label without disadhereing said remaining portion of said lower label at least around said removable region thereof, an enclosure adhesively adhered surrounding said removable region of said container surface, said enclosure comprising at least a cover and a base coupled by a hinge, said base adhered to at least one of said container surface and said lower label, said cover disposed over said removable region of said container surface for access thereto.

27. The device of claim 26, wherein said enclosure is further comprised of a material more rigid than said container material.

28. The device of claim 26, wherein said first removable region is generally in the shape of a football.

29. The device of claim 26, wherein the product is interleaved tissues.

30. The device of claim 26, wherein the product is perforated tissues.

* * * * *